US005303832A

United States Patent [19]

Tu

[11] Patent Number: 5,303,832

[45] Date of Patent: Apr. 19, 1994

[54] HANGER ASSEMBLY

[76] Inventor: Wen-Wu Tu, No. 28, Alley 55, Lane 208, Sec. 3, Hsi Tun Rd., Taichung, Taiwan

[21] Appl. No.: 29,145

[22] Filed: Mar. 10, 1993

[51] Int. Cl.[5] ..... A47F 5/00

[52] U.S. Cl. ..... 211/105.4; 211/123

[58] Field of Search ..... 211/123, 105.1, 105.3, 211/105.4; 248/261, 264

[56] References Cited

U.S. PATENT DOCUMENTS 3,040,902 6/1962 Dunn ..... 211/105.4
3,948,475 4/1976 Jones ..... 211/105.4 X
3,951,269 4/1976 Anderson ..... 211/105.4
4,895,471 1/1990 Geltz et al. ..... 211/105.3 X

FOREIGN PATENT DOCUMENTS 319128 9/1929 United Kingdom ..... 248/264

*Primary Examiner*—Robert W. Gibson, Jr.
*Attorney, Agent, or Firm*—Abelman Frayne & Schwab

[57] ABSTRACT

A hanger includes one or more tubes, a stub extended axially outwards from each end of the tubes, a sleeve threadedly engaging with each of the stubs, and a head having an extension threadedly engaged to each of the sleeves. The extensions and the heads are adjustable relative to the tube such that the heads are movable either axially outwards or inwards of the hanger.

4 Claims, 6 Drawing Sheets

HANGER ASSEMBLY

BACKGROUND OF THE INVENTION

1. Field of the Invention

The present invention relates to a hanger, and more particularly to a hanger assembly.

2. Description of the Prior Art

Typical hangers include a rod having a predetermined length and having both ends each supported on a support, the length of the rods can not be adjusted such that two supports should be fixed on a pair of oppositely facing walls and the rod should be cut to suitable length before the hanger can be fixed between the walls.

The present invention has arisen to mitigate and/or obviate the afore-described disadvantages of the conventional hangers.

SUMMARY OF THE INVENTION

The primary objective of the present invention is to provide a hanger assembly in which the length of the hanger is adjustable such that the hanger assembly can be fixed between walls without additional supports.

In accordance with one aspect of the invention, there is provided a hanger assembly comprising at least one tube including two ends each having a stub extended therefrom, an outer thread formed on each of the stubs, a sleeve including an inner thread for threadedly engaging with the outer thread of each of the stubs, a head including an extension threadedly engaged to each of the sleeves and adjustable relative to the tube such that the heads are movable either axially outwards or inwards of the hanger assembly, and a barrel threadedly engaged on each of the extensions for fixing the extensions to the sleeves.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
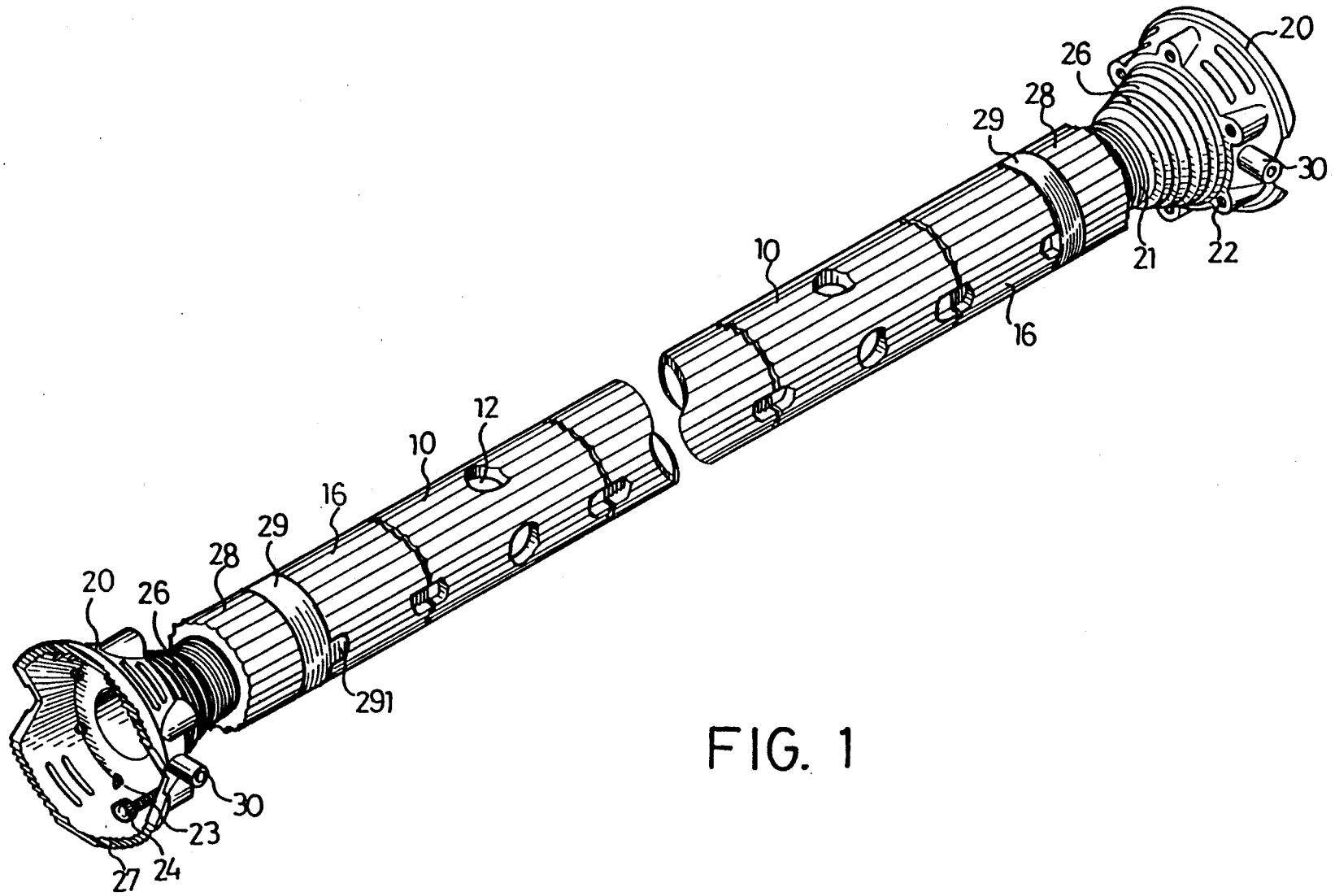
FIG. 1 is a perspective view of a hanger assembly in accordance with the present invention.
Figure 2:
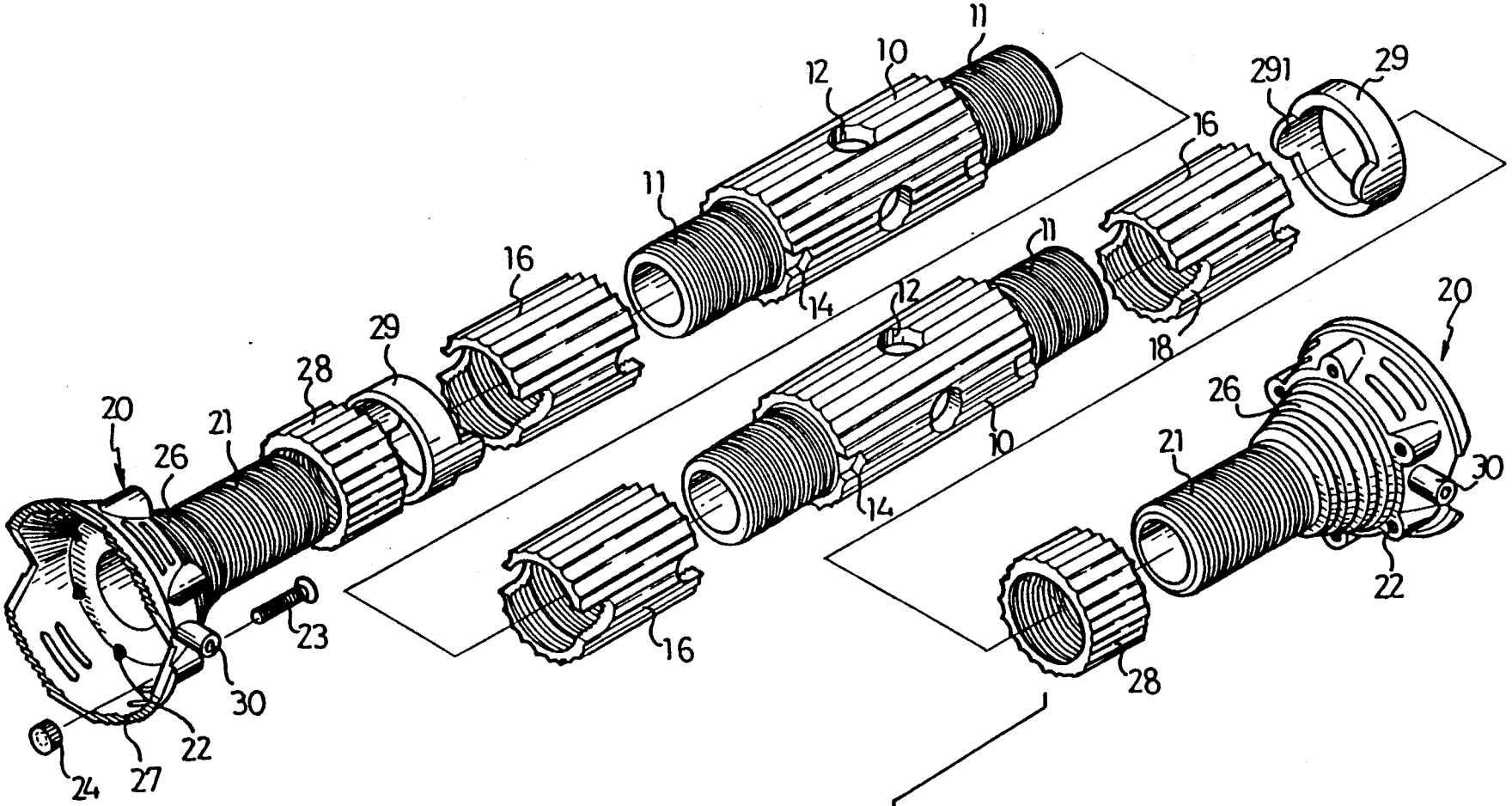
FIG. 2 is an exploded view of the hanger assembly.

Referring to the drawings, and initially to FIGS. 1 to 4, a hanger assembly in accordance with the present invention comprises one or more tubes 10 each including two ends having a stub 11 formed thereon, an outer thread formed on each of the stubs 11, a plurality of openings 12 formed in the middle portion of each of the tubes 10, a pair of opposite notches 14 formed in each of the ends of each of the tubes 10 close to the respective stubs 11, a sleeve 16 threadedly engaged with the outer threads of the stubs 11 in order to couple the tubes 10 together, each of the sleeves 16 includes two ends each having a pair of notches 18 oppositely formed therein, and two heads 20 secured to the end portions of the coupled tubes 10 for fixing the hanger assembly between wall members 90.

Figure 3:
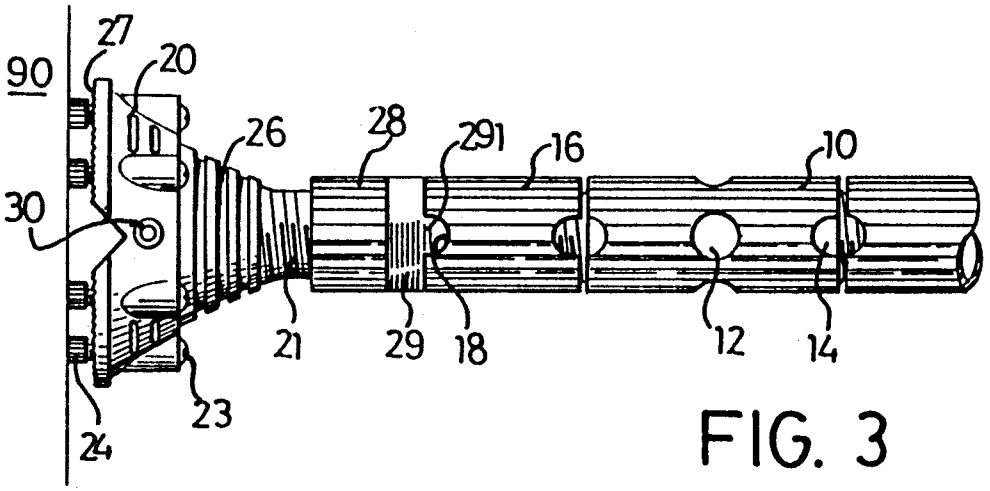
FIGS. 3 and 4 are partial side views illustrating the attachment of the hanger assembly to a wall member.

Each of the heads 20 includes an extension 21 having an outer thread formed thereon and a plurality of screw holes 22 arranged in circular and formed in parallel to the longitudinal direction thereof for threadedly engaging with the screws 23, a cap 24 threaded to the free end of each of the screws 23 and engageable with the wall members 90, best shown in FIG. 3, and at least one annular groove 26 formed in the abutment area of the head 20 and the extension 21. Each of the heads 20 includes a serrated outer surface 27 for engagement with the wall members 90, best shown in FIG. 4, such that the heads 20 can be solidly secured to the wall members 90. A barrel 28 is threadedly engaged with each of the extensions 21. The sleeves 16 have a length larger than that of the stubs 11 such that the sleeves 16 are long enough for engaging with both the stub 11 and the extension 21 simultaneously, such that the heads 20 can be coupled to the tubes 10. A ring 29 is engaged on each of the extensions 21 and includes a pair of protrusions 291 extended therefrom for engagement with the notches 18 of the sleeves 16, the sleeves 16 can be solidly fixed to the extensions 21 when the barrels 28 are rotated toward the respective sleeves 16. Each of the heads 20 includes a projection 30 radially extended outward therefrom and preferably having an aperture formed therein for engagement with a tool, such as a stick, so that the heads 20 can be easily rotated.

Figure 4:
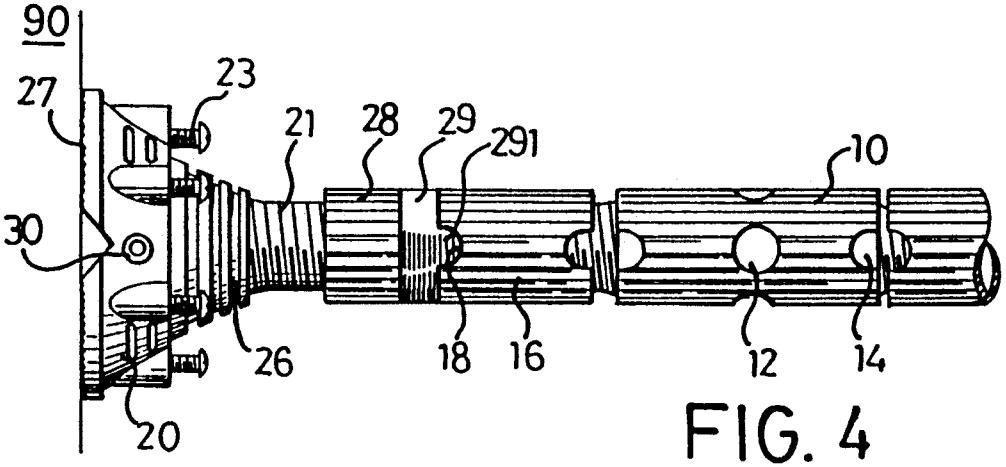

In operation, as shown in FIGS. 3 and 4, the hanger assembly can be secured between a pair of opposite wall members 90, the extensions 21 can be adjusted relative to the sleeve 16, i.e., the heads 20 and the extensions 21 can move either axially outwards or inwards of the hanger assembly such that the heads 20 can be forced against the wall members 90 and such that the hanger assembly can be secured between the wall members 90. It is to be noted that the screws 23 may move relative to the heads 20, i.e., may be adjusted relative to the heads 20 such that the hanger assembly can further be forced against the wall members 90 by the screws 23.

Figure 6:
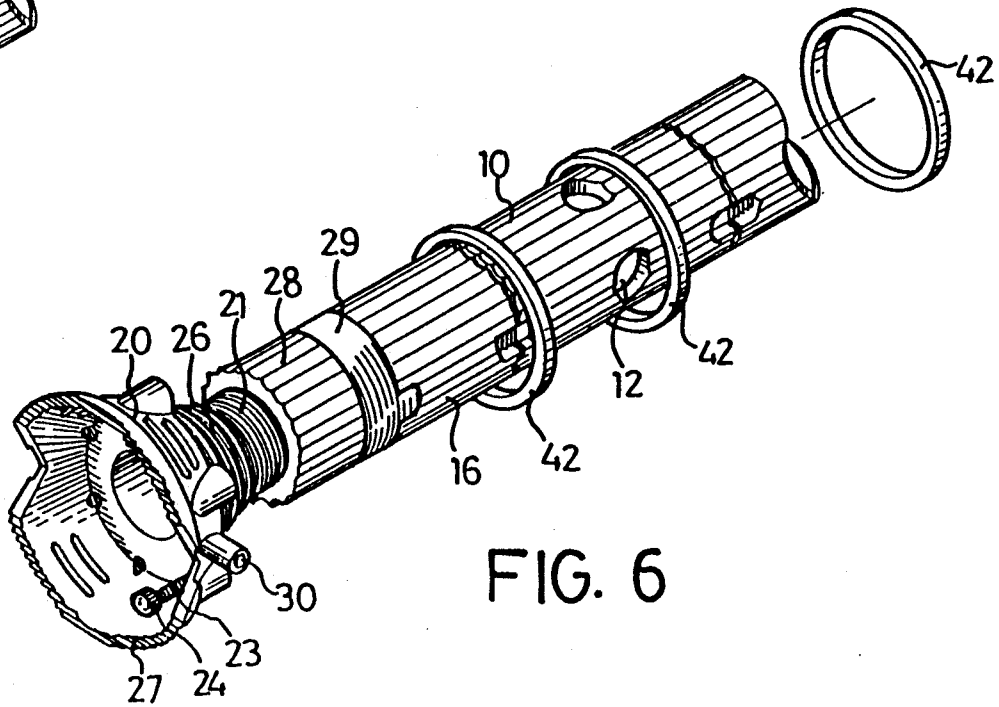
FIGS. 5, 6 and 7 are partial perspective and partial exploded views illustrating the applications of the hanger assembly.
Figure 5:
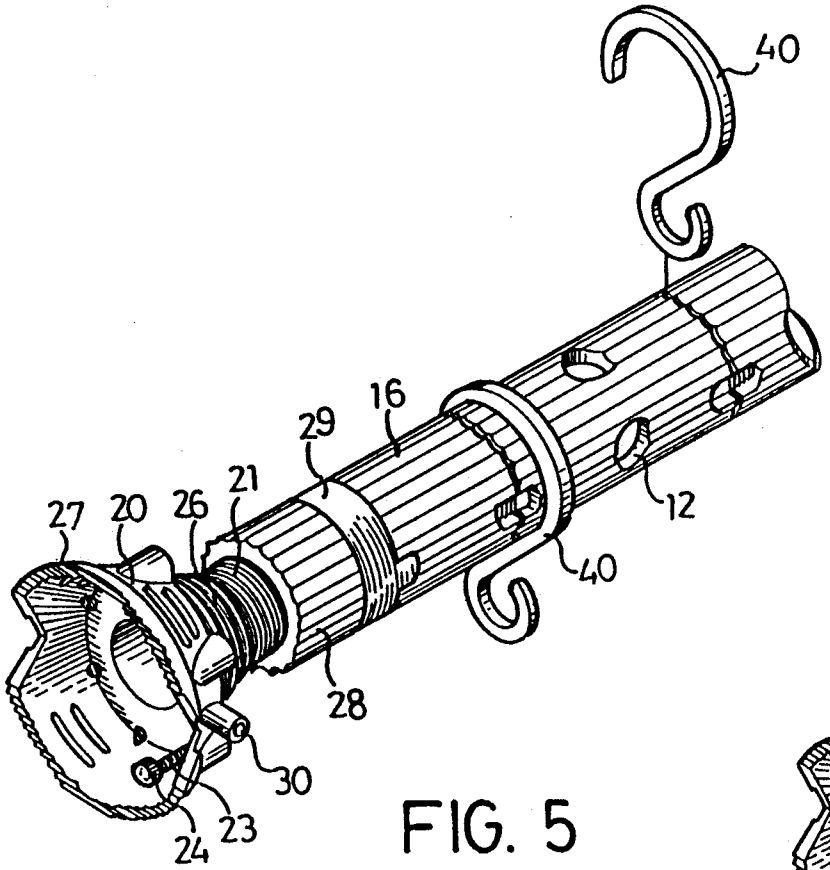
Figure 8:
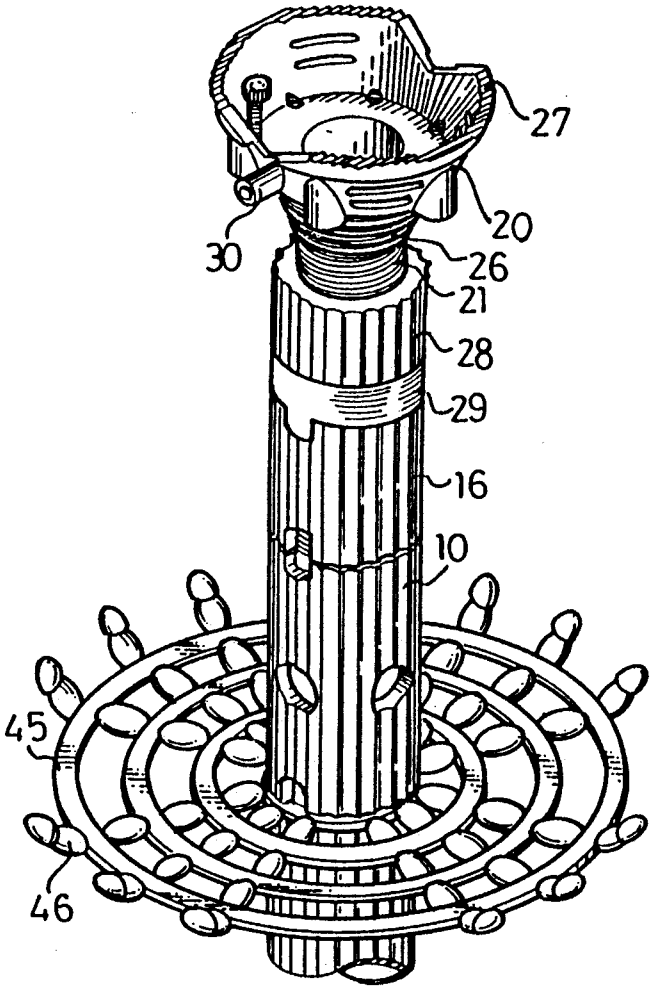
FIG. 8 is a perspective view in which the hanger assembly is erected.
Figure 7:
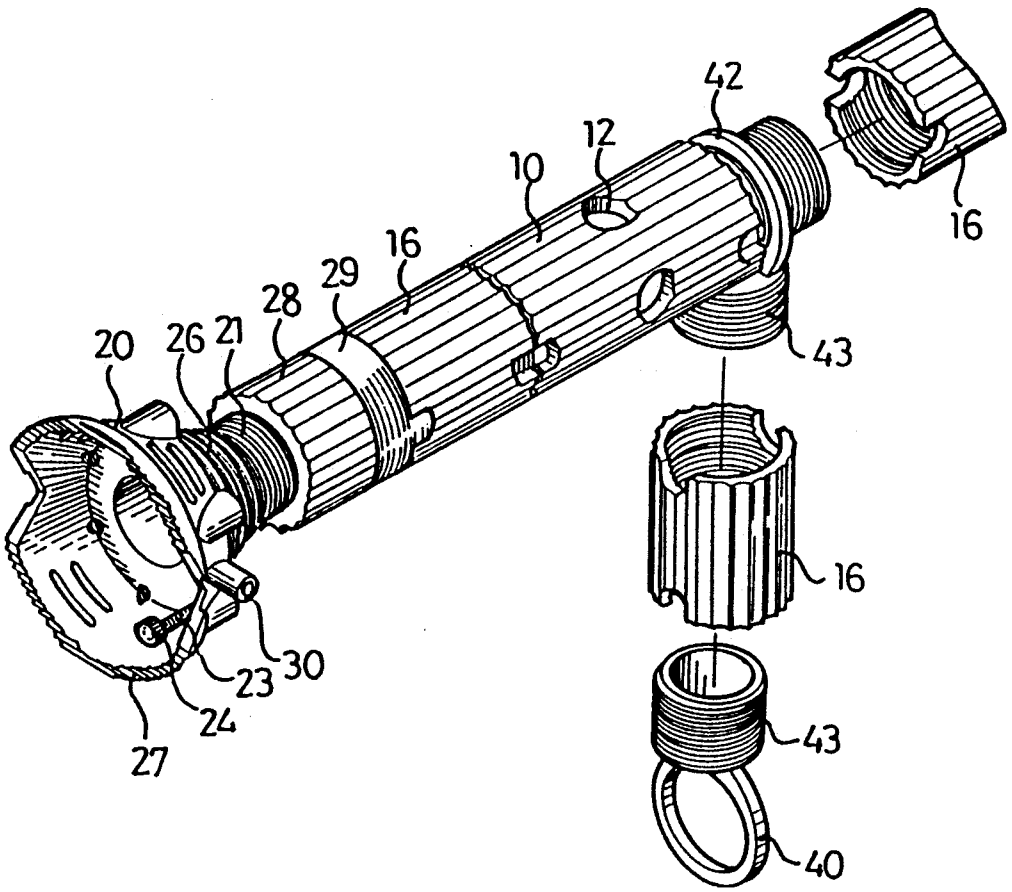
Figure 9:
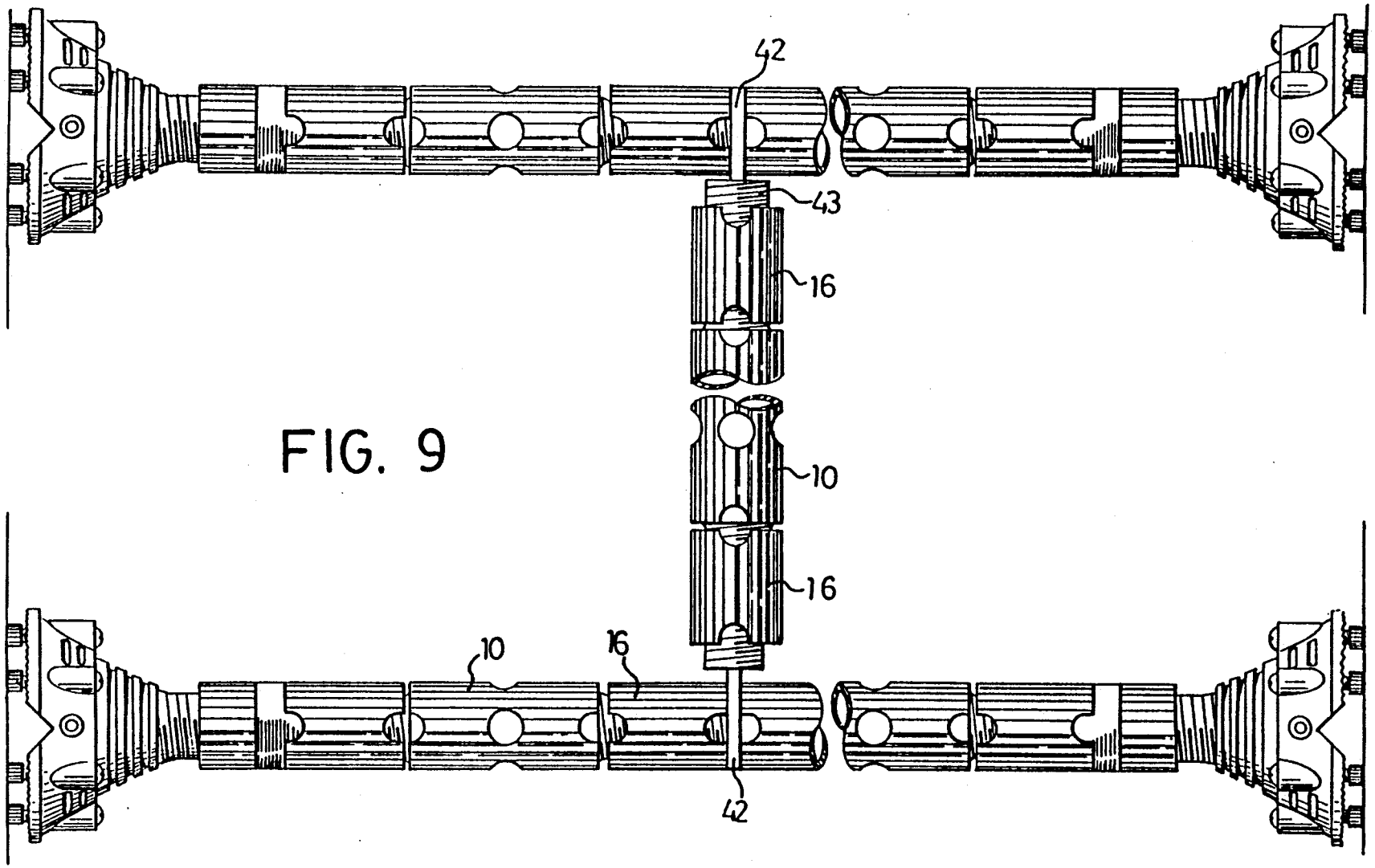
FIG. 9 is a side view illustrating the application of the hanger assembly.

Referring next to FIGS. 5 and 6, hooks 40 or rings 42 can be engaged on the hanger assembly and with which the coat hangers can be attached to the hanger assembly. As shown in FIG. 7, the ring 42 may include a bolt 43 secured thereto, a sleeve 16 and another bolt 43 and a lower ring 40 may be secured to the bolt 43 such that the lower ring 40 can be provided for other usage. Alternatively, the coat hangers may directly be engaged with the openings 12 for attaching to the hanger assembly. As shown in FIG. 8, the hanger assembly can be erected, and a plurality of rings 45 and couplers 46 can be secured between the tubes 10 so as to form a clothes tree. As shown in FIG. 9, two hanger assemblies may be secured between the wall members 90 and can be coupled together by tube 10, sleeves 16, bolts 43 and rings 42, such that more coat hangers or clothes can be hung on the hanger assembly.

Accordingly, the hanger assembly in accordance with the present invention can be easily secured between the wall members without fixing additional supports on the wall members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hanger assembly comprising at least one tube including two ends each having a stub extended therefrom, an outer thread formed on each of said stubs, a sleeve including an inner thread for threadedly engaging with said outer thread of each of said stubs, a head including an extension threadedly engaged to each of said sleeves and adjustable relative to said tube such that said heads are movable either axially outwards or inwards of said hanger assembly, and a barrel threadedly engaged on each of said extensions for fixing said extensions to said sleeves.

2. A hanger assembly according to claim 1, wherein each of said heads includes a plurality of screw holes formed therein, a screw threaded with each of said screw holes, said screw holes and said screws are arranged in parallel to said extensions and said screws are adjustable relative to said heads.

3. A hanger assembly according to claim 1, wherein each of said sleeves includes at least one notch formed in one end thereof, and a spacer engaged on each of said extensions and including at least one protrusion formed thereon for engagement with said notch of said sleeve.

4. A hanger assembly according to claim 1, wherein each of said heads includes a projection extended therefrom for facilitating rotation of the heads.

* * * * *